US006209976B1

(12) United States Patent
Shear

(10) Patent No.: US 6,209,976 B1
(45) Date of Patent: Apr. 3, 2001

(54) CABINET BOX

(76) Inventor: Frank Shear, 3 Grove Isle, Coconut Grove, FL (US) 33133

( * ) Notice: Subject to any disclaimer, the term of this patent is extended or adjusted under 35 U.S.C. 154(b) by 0 days.

(21) Appl. No.: 09/336,847

(22) Filed: Jun. 21, 1999

(51) Int. Cl.[7] ..... A47B 47/00
(52) U.S. Cl. ..... 312/263; 312/257.1
(58) Field of Search ..... 312/257.1, 263, 312/264, 265.5, 265.6

(56) References Cited

U.S. PATENT DOCUMENTS

| | | | | |
|---|---|---|---|---|
| 1,735,375 | * | 11/1929 | Card et al. | 312/257.1 |
| 1,798,182 | * | 3/1931 | Vance et al. | 312/263 |
| 2,571,622 | * | 10/1951 | Schmidt | 312/263 |
| 2,701,174 | * | 2/1955 | Franks | 312/263 |
| 3,065,038 | * | 11/1962 | Pipe | 312/263 |
| 3,472,572 | * | 10/1969 | Himelreich | 312/330.1 X |
| 3,749,465 | * | 7/1973 | Newcomer | 312/263 X |
| 4,819,802 | * | 4/1989 | Gutierrez | 312/9.57 X |
| 4,836,626 | * | 6/1989 | Taylor et al. | 312/257.1 |
| 5,382,088 | * | 1/1995 | Young | 312/263 |
| 5,713,649 | * | 2/1998 | Swift | 312/257.1 |
| 5,951,131 | * | 9/1999 | Stefan | 312/263 X |

FOREIGN PATENT DOCUMENTS

| | | | | |
|---|---|---|---|---|
| 645808 | * | 11/1950 | (GB) | 312/257.1 |

* cited by examiner

*Primary Examiner*—Peter M. Cuomo
*Assistant Examiner*—Hanh V. Tran

(57) ABSTRACT

A cabinet box has two side panels such that each has an inset, protruding wall face formed by, and relative to, recessed or pocketed ends located at the top and bottom thereof, respectively. The side panels are identical in shape and configuration. Top and bottom panels are configured so that their ends fit snugly into the side panel pockets and into the top and bottom pockets of a back panel. Self tapping screws or rivets are provided to secure the panels together. A door may be added, as well as leveling legs if the box is to rest above the ground surface. Further, a wall rail may be provided to allow the cabinet box to be wall mounted.

13 Claims, 5 Drawing Sheets

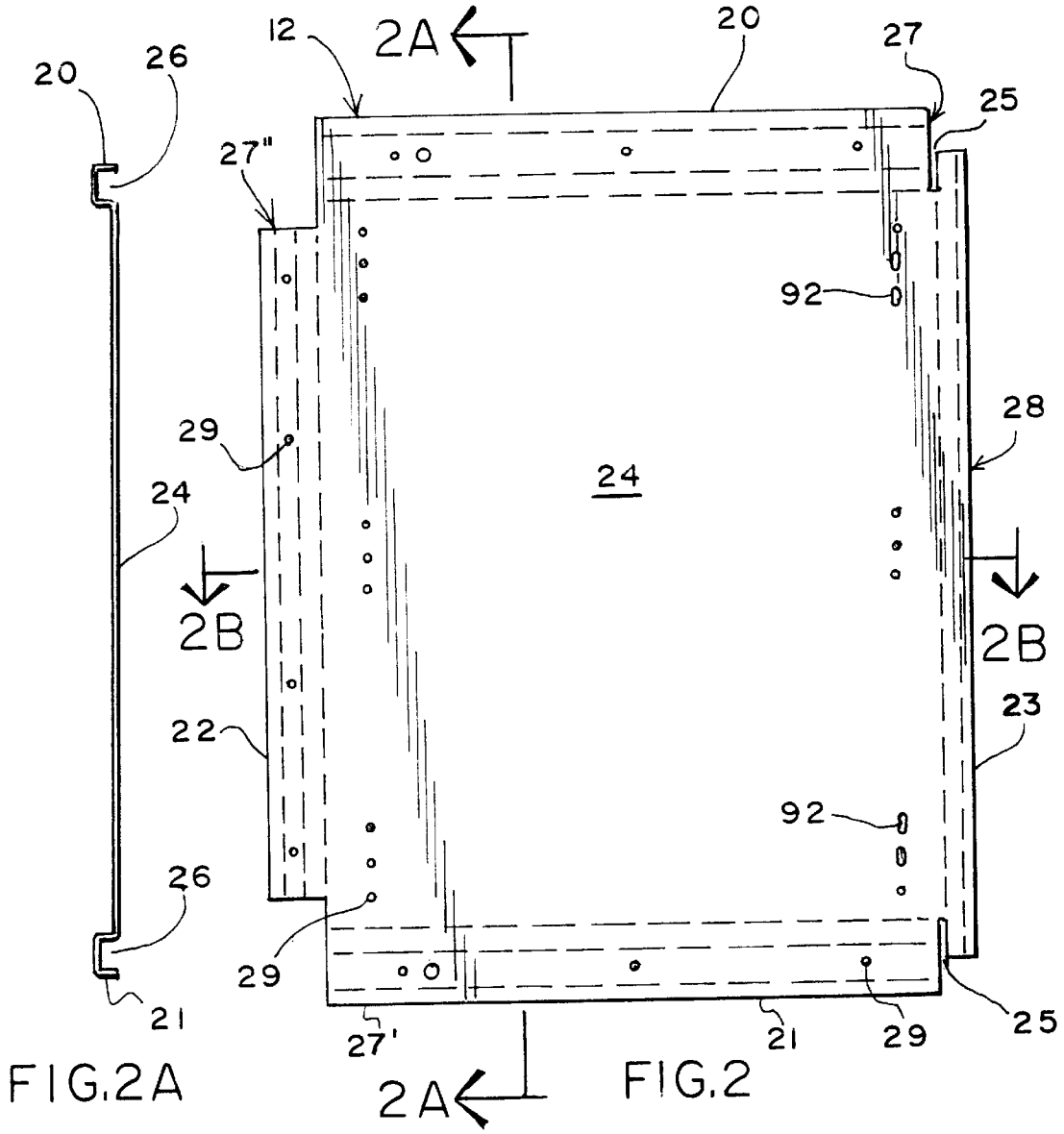
FIG.2A
FIG.2
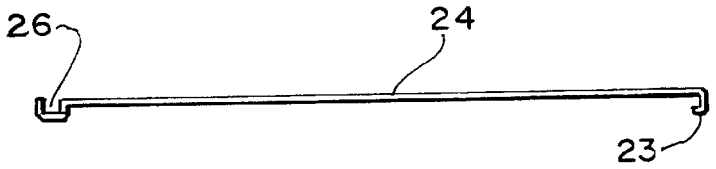
FIG.2B

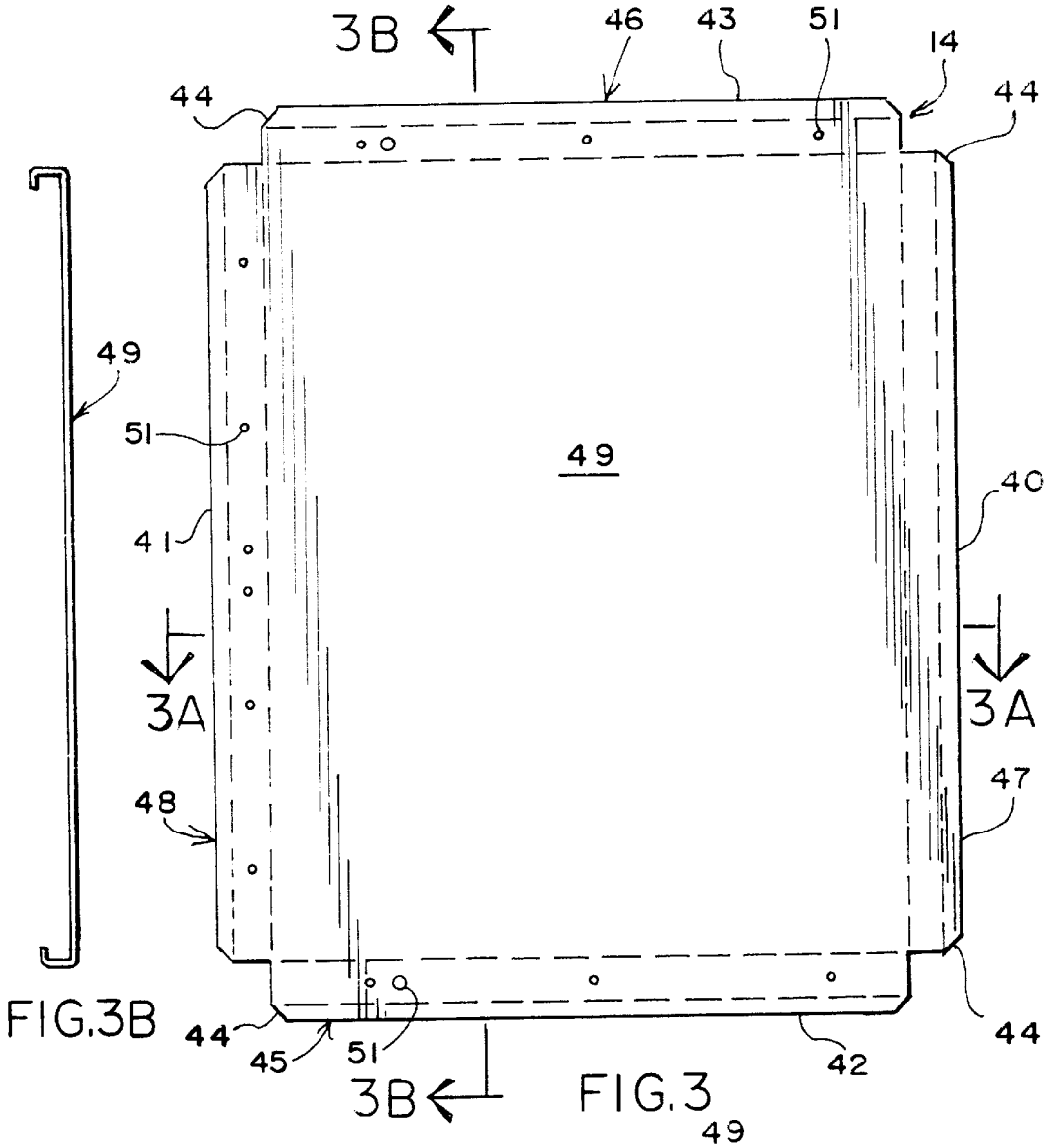
FIG.3B
FIG.3
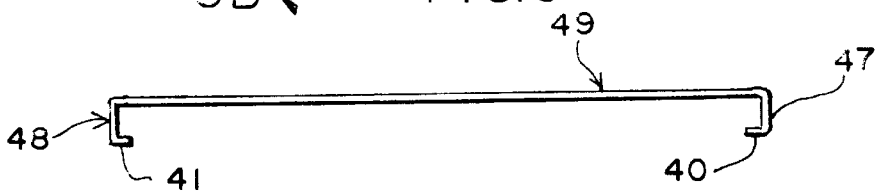
FIG.3A

CABINET BOX

FIELD OF THE INVENTION

The present invention relates to a cabinet box. More particularly, the present cabinet box is preferably formed from metal and is capable of being assembled or disassembled with relative ease using a knock down system. The cabinet box has a tightly jointed interior formed from the assembly of novel side panels, top and bottom panels and a back panel.

BACKGROUND OF THE INVENTION

Cabinet boxes, and particularly, metal cabinet boxes, come in a multitude of designs, shapes and manners of construction. For example, in U.S. Pat. No. 4,296,982 to Kullander, a knock down cabinet assembly is taught. This assembly comprises a cabinet having interconnected walls by means of specially shaping the adjacent portions thereof so that assembly of the cabinet can occur without fastening means. In Viklund, U.S. Pat. No. 4,295,693, a cabinet having a rear wall, two side walls and a frame-shaped front wall forming a box-like structure is shown. This cabinet of Viklund also requires no fastening devices and interconnected portions thereof also serve as means for receiving shelf supports. Other examples of some knock down cabinets can be seen in Znamirowski et al., U.S. Pat. No. 4,288,132 and Radi, U.S. Pat. No. 3,104,140. These prior art devices, and others, attend to their intended purpose of forming cabinets but do not attend to the advantages taught by the present invention.

SUMMARY OF THE INVENTION

A cabinet box having a tightly jointed interior is shown and described herein. Two Side panels each have an inset wall face formed by, and relative to, recessed or pocketed ends located at the top and bottom thereof, respectively. In addition, the rear of the side panels incorporates a separate pocket for receiving the back panel. The side panels are identical in shape and configuration. Top and bottom panels are configured so that their ends fit snugly into the side panel pockets. A back panel also has an inset face formed by, and relative to, recessed or pocketed ends located at the top and bottom thereof, respectively. The components are fastened to one another by self tapping screws, rivets, or other conventional means. A door may be added, as well as leveling legs if the box is to rest above the ground surface. Further, means are provided to allow the cabinet box to be wall mounted.

It is thus an object of the present invention to provide a novel side panel having top, bottom and rear ends where pockets are located at those ends.

It is still another object of the present invention to provide a cabinet box that is formed from novel side panels having top, bottom and rear ends where pockets are located at those ends.

It is still another object of the present invention to provide a novel back panel having receiving recesses formed at the top and bottom thereof to accept mating ends of top and bottom panels, and novel side edges for being matably received by the rear ends of the said side panels.

It is still yet another object of the present invention to provide a cabinet box that is formed of sheet metal which has bends in side and back panels such that the bends form pockets or recessed compartments at the top and bottom of each said panel.

It is still another object of the present invention to provide a knock down metal cabinet having prefabricated holes for fastening components thereof by self tapping screws or other similar means.

It is still another object of the present invention to provide a cabinet box that can be shipped unassembled permitting assembly to be performed away from the manufacturing facility without special equipment and by personnel unfamiliar with the manufacturing process.

It is still yet another object of the present invention to provide a cabinet box whose side panels may be attached at either the left or right sides of the box.

It is still yet another object of the present invention to provide side panels that are capable of universal fastening of a door for either right or left handed attachment.

It is still yet another object of the present invention to provide leg leveling means and/or wall attachment means to assist in the assembly and installation of the disclosed cabinet box.

THE DRAWINGS

Other objects and advantages of the present invention will become apparent from the following detailed description of preferred embodiments thereof taken in conjunction with the accompanying drawings which include:

FIG. 2 is a plan view of the side panel of the present invention showing bend lines in dashes;

FIG. 2A is a cross section view of the side panel shown after pockets have been formed from bend lines taken along line 2A of FIG. 2;

FIG. 2B is a cross section view of the side panel shown after a pocket has been formed from bend lines at the rear of the panel and front edge bends have been made along front bend lines taken along line 2B of FIG. 2;

FIG. 3 is a plan view of the top panel of the present invention showing bend lines in dashes, the bottom panel being a mirror image thereof;

FIG. 3A is a cross section view of the top/bottom panel shown after bends have been taken along line 3A of FIG. 3;

FIG. 3B is a cross section view of the top/bottom panel shown after bends have been taken along line 3B of FIG. 3;

DETAILED DESCRIPTION OF A PREFERRED EMBODIMENT

Figure 1:
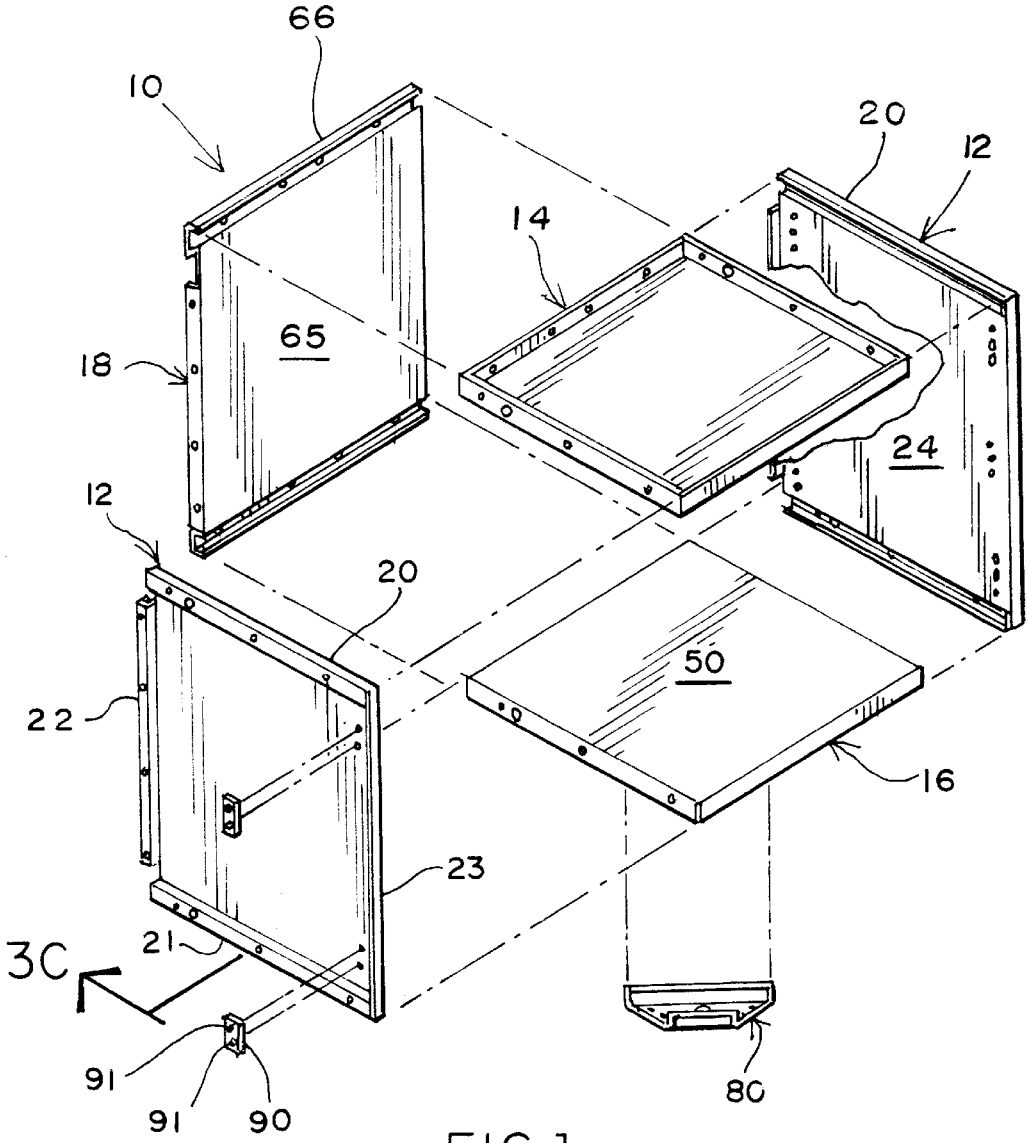
FIG. 1 is a perspective view of the present invention shown schematically in disassembled form.

Referring to FIG. 1, a preferred embodiment of the cabinet box 10 is shown. It is preferred that box 10 be manufactured of sheet metal, though any conventional construction material may be used. The dimensions of the sheet metal are established to suit the required height, width and depth of the finished box 10, allowing for the necessary metal bends, as depicted in the drawings, around the perimeter of the respective panels. The gauge of sheet metal may vary depending upon the strength, size, and economic requirements of the finished box 10. Various shaped cut outs and holes are made in each piece of sheet metal to accommodate the final bending, fastening and hardware placement requirements of the panels as hereinbelow described.

Cabinet box 10 is comprised of two side panels 12, which may be identical to one another; a top panel 14 and a bottom panel 16, which also may be identical to one another, and; a back panel 18. Optionally, other components may be added such as doors, drawers, shelves or accessories (not shown).

FIG. 2 depicts side panel 12 shown in the preferred embodiment of sheet metal construction material. Bend locations are shown in dashed lines and bends are to form 90 degree angles throughout this Specification unless otherwise described. Panel 12 comprises a top edge 20, an opposed bottom edge 21, and a rear edge 22 and opposed front edge 23. The side panel 12 has a wall face 24 which will comprise the interior wall component of the side panel 12 when forming the box 10. As shown, side panel 12 is substantially rectangular. Bend gaps 25 permit unobstructed formation of side panel 12 configuration so that 90 degree bends result in substantially tight fitting joints of the cabinet box 10. The bend gaps 25 can measure up to two inches (2") in length, but the preferred length is approximately one-eighth inch (⅛").

Pockets 26 are formed by bending at the dashed lines along the top edge 20, bottom edge 21 and rear edge 22 of side panel 12. The bend profiles of pockets 26 may be readily seen in FIGS. 2A and 2B. These bend profiles are achieved by bending top flange 27 and bottom flange 27' along the respective bend line (dashed lines) closest to the wall face 24 in a direction opposite of the wall face 24 and substantially 90 degrees thereto. Thereafter, each subsequent bend line is bent so that a pocket 26, or substantial U-shape, is formed. The pocket 26 is then secured and/or reinforced by bending front flange 28 such that the bend line on front flange 28 closest to the wall face 24 is bent in a direction opposite that of the wall face 24 and substantially 90 degrees thereto. The remaining bend line on flange 28 is bent so as to achieve as substantial U-shape cross section as shown in FIG. 2B (see front edge 23). The purpose of creating this substantial U-shaped cross section for flange 28 is to enhance the stiffness of the front edge 23 of the side panel 12. Thus, the preferred embodiment of side panel 12 is substantially rectangular in shape. Additionally, for ease of assembly, any number of pre-punched holes 29 may be added to the side panel 12 to permit fastening means such as self tapping screws to secure one panel of the cabinet box 10 to other cabinet boxes or for hardware mounting purposes.

The pocket 26 formed from the rear edge 22 of side panel 12 is created in similar fashion to the pockets 26 formed along the top edge 20 and bottom edge 21. The first bend in rear flange 27" is directed away from the wall face 24 and substantially 90 degrees thereto. The remaining bends form substantially a U-shape pocket 26 as represented in FIG. 2B.

Figure 3C:
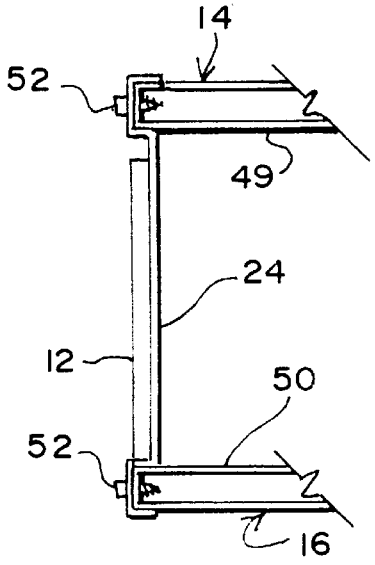
FIG. 3C is a cross section view of the top and bottom panels of the present invention connected to a side panel of the present invention.

FIG. 3 illustrates the top panel 14 of the cabinet box 10. The bottom panel 16 is a mirror image of the top 14, though incomplete panels known as stretchers may also be employed for top and/or bottom panels. The top panel 14 is comprised of a front edge 40, and an opposed rear edge 41. The top panel 14 also is comprised of opposed side edges 42 and 43, respectively. The corners 44 of each edge of top panel 14 (reference numerals 40, 41, 42 and 43) are beveled, or angled at 45 degrees preferably. The beveled corners permit an adjacent fit with one another when the panel 14 is formed as discussed below. Dashed lines represent bend lines for top panel 14. Side flanges 45 and 46 respectively, front flange 47 and rear flange 48 of top panel 14 each depict two bend lines. Ninety degree bends are made in the respective flanges at the bend lines closest to the face 49 of the top panel 14 and in a direction opposite to that of, or away from, the face 49, so that the face 49 of top panel 14 can form the interior of the top component of the cabinet box 10. The remaining bend line on each flange of the top panel 14 is formed at an angle of 90 degrees from the first bend resulting in a bend profile from front edge 40 to rear edge 41 having a substantial C-shape (see FIG. 3A). A similar, substantial C-shape is profiled in FIG. 3B after bending the top panel 14 from side edge 42 to side edge 43. The C-shape profiles disclosed in this top panel 14 are formed in the same direction as one another, and away from the face 49. The side edges, 42 and 43, respectively, of top panel 14, after bending and in the top panel's substantial C-shape configuration, are alignable with, and formed to engage, the upper pocket 26 of each of two side panels 12, resulting in a tightly fitted joint between each side edge of top panel 14 and the upper pockets 26 of side panels 12.

The bottom panel 16 is constructed and bent identically to that of the top panel 14, and its C-shaped side edges are engagable with the lower pockets 26 of each of the two side panels 12 (which are fitted with the top panel) forming the floor 50 of the cabinet box 10. Pre-punched holes 51 may be added to the top panel 14 and bottom panel 16 to permit fastening means such as self tapping screws 52 or rivets to secure those panels to the side panels 12 (see FIG. 3C).

Figures 4, 4A, 4B:
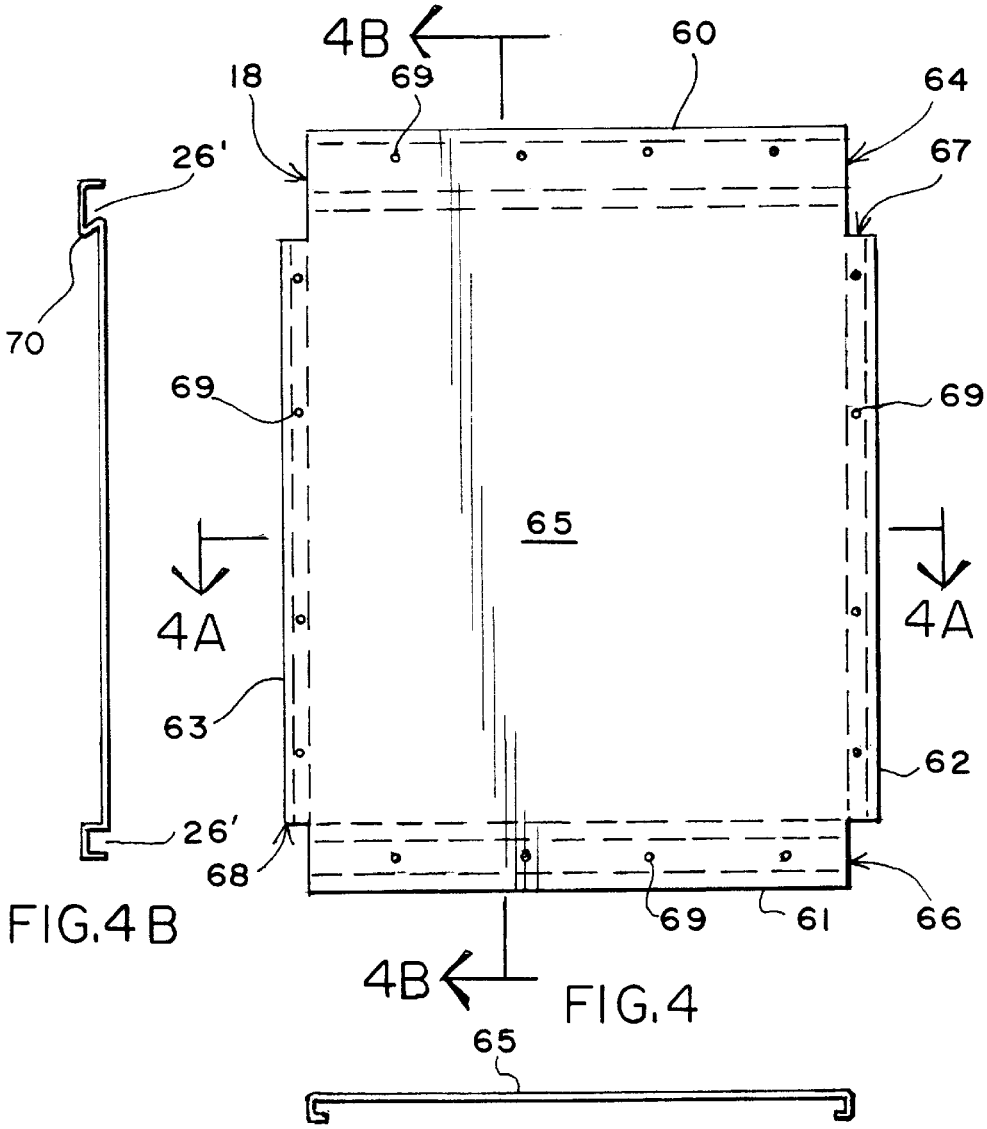
FIG. 4 is a plan view of the back panel of the present invention showing bend lines in dashes.
FIG. 4A is a cross section view of the back panel shown after pockets have been formed from bend lines taken along line 4A of FIG. 4.
FIG. 4B is a cross section view of the back panel shown after pockets have been formed from bend lines taken along line 4B of FIG. 4.

FIG. 4 illustrates the back panel 18 of cabinet box 10. Dashed lines again represent bend lines with the back panel 18 as with the side, top and bottom panels. Back panel 18 has an opposed top edge 60 and a bottom edge 61. Back panel is further framed by two opposed side edges 62 and 63 respectively. Top flange 64 of the top edge 60 of back panel 18 comprises three bend lines. The top flange 64 is bent back, and away from, the face 65 at the first such bend line closest to the face 65 of back panel 18 at an angle in excess of 90 degrees and approximately 135 degrees. Then the unbent portion of the top flange 64 located at the bend line second closest to the back face 65 is bent in a direction parallel to the face and in a direction opposite of the bottom edge 61 forming a lip 70 (FIG. 4B). The final bend of top flange 64 at the bend line farthest away from the face 65 is made at approximately 90 degrees and toward the back face 65 which creates a pocket 26'.

The back panel 18 also has a bottom flange 66, which is opposite that of the top flange 64. A second pocket 26' is formed at the bottom edge 61 of panel 18 as seen in FIG. 4B. This second pocket 26' is achieved by bending flange 66 along the bend line (dashed lines) closest to the wall face 65 in a direction opposite of the wall face 65 and substantially 90 degrees thereto. Thereafter, each subsequent bend line is bent so that a pocket 26', or substantial U-shape, is formed.

The back panel also has opposed side flanges 67 and 68, respectively. Each of these flanges, 67 and 68, has a two bend lines. The respective flanges are each bent at the line closest to the face 65 in a direction behind the face and at the second bend line toward one another forming a substantial C-shape cross section as represented in FIG. 4A. The back panel flanges may contain pre-punched holes 69 for connection of the back panel 18 to the side panels 12, the top panel 14 and bottom panel 16 of cabinet box 10 by self tapping screws 52, rivets or other means (see FIG. 4C).

The cabinet box 10 is thus assembled at the least by utilizing two side panels 12, one top panel 14, one bottom panel 16, and one back panel 18 secured together by conventional means as disclosed above forming the box 10. Once all bends are made as recited above, the rear edges 41 of the top panel 14 and bottom panel 16, are matably inserted into upper and lower pockets 26' of the back panel 18 resulting in tightly fitted joints. Then, side edges, 62 and 63, of the back panel 18 and the side edges 45 and 46 of the top and bottom panels, 14 and 16, respectively, are inserted into the top, bottom and rear pockets 26 of side panels 12 forming tightly fitted joints. Fasteners are used to secured the components together.

Figure 4C:
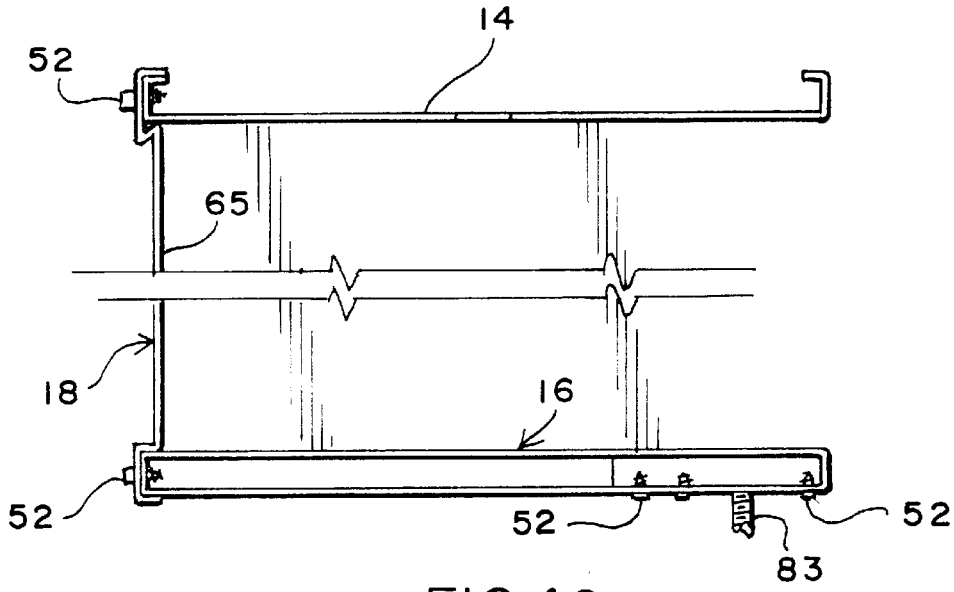
FIG. 4C is a broken, cross section view of the present invention depicting securement of the back panel of the present invention to the top and bottom panels thereof.
Figure 4D:
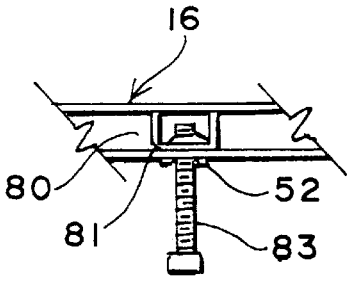
FIG. 4D is cross section view of the leg component of the present invention secured to the bottom panel thereof.
Figure 4E:
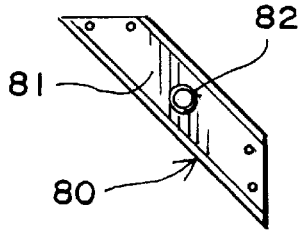
FIG. 4E is a plan view of a leg support channel member.

Leg support channels 80 may be employed optionally if desired to support the box 10 on legs. FIGS. 4C and 4D depict the channel members 80 in a diagonal placement in the four bottom corners of the underside of the bottom panel 16, and secured in place with self tapping screws 52. The web 81 of channel 80 is wedged horizontally in the underside of the bottom panel 16 and downwardly facing the ground surface. A deep drawn hole 82 is located in the web 81 of channel 80 for the purpose of receiving a leg 83. The hole 82 may be threaded for receiving a matably threaded leg 83 for height adjustment and leveling of the box 10.

The cabinet box 10 may have an optional door (not shown). If a door is desired, hardware back up plates 90, shown in FIG. 1, are designed with holes 91 spaced between 25 and 40 centimeters apart, and preferably 32 centimeters, center to center, which preference is the current standard hole spacing for door hinge mounting plates (not shown). These holes 91 may be plain to receive self tapping fasteners or pre-tapped to receive machine screws. The plates 90 are to be affixed to the side panels 12 and to the exterior of the cabinet box 10, opposite the door hinge mounting plates. The plates 90 receive mounting screws (not shown) from the door hinge mounting plates which are inserted through the elongated holes 92 located on the side panel 12 (FIG. 2) toward the front edge 23 thereof, in an alignment to receive the standard dimensions of the door hinge mounting plates. The purpose of having elongated holes 92 is to allow the hinge location to adjust vertically. This adjustment allows the door hinge to be spaced equally from both its top and bottom edges. In this manner, the same door can be mounted on the right or left side of the box 10, eliminating the need for hinging doors right specific or left specific.

Figure 5A:
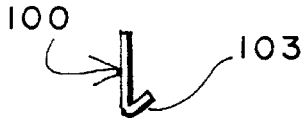
FIG. 5A is a cross section view of the wall hang rail component of the present invention after bends are completed in the bend lines thereof.
Figure 5:
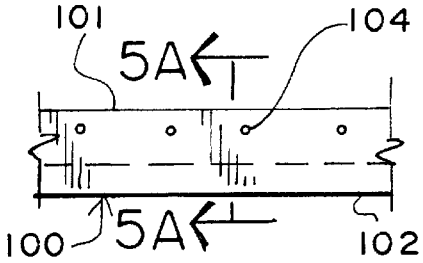
FIG. 5 is a plan view of the wall hang rail component of the present invention where bend lines are represented by dashes.

Further, if it is desired to have a wall hung cabinet box 10, a wall hang rail 100 is shown in FIG. 5. The rail 100 has a top edge 101 and a bottom edge 102. The bottom edge 102 is deformed along a bend line (represented by dashed lines) at less than 90 degrees to that of the top edge 101 and forms a pocket 103. Pocket 103 is formed to receive lip 70 of back panel 18 in a matable relationship. The rail 100 is secured to a wall (not shown) by fasteners inserted through pre-punched holes 104. FIG. 5A depicts the profile of the rail 100 after bending as disclosed herein. The wall hang rail 100 can be fabricated in various materials, preferably sheet metal, and cut in different lengths as required by the installation.

In describing the invention, reference has been made to preferred embodiments. Those skilled in the art, however, and familiar with the disclosure of the subject invention, may recognize additions, deletions, modifications, substitutions and/or other changes which will fall within the purview of the subject invention as defined by the following claims.

What is claimed is:

1. A side panel for a cabinet box comprising a wall face, a top edge including a top flange and an opposed bottom edge including a bottom flange; a front edge including a front flange and an opposed rear edge including a rear flange, said flanges defining a face, and wherein a first upper pocket member formed from said top flange frames said face at the top edge and a second lower pocket member formed from said bottom flange frames said face at the bottom edge, wherein each said upper and lower pocket members is formed by having a first portion extending substantially perpendicular to said wall face, a second portion extending substantially perpendicular to the first portion and a third portion extending substantially perpendicular to said second portion, said pocket members are formed in the same direction as said face.

2. The side panel of claim 1, wherein a third pocket member is formed from said rear flange.

3. The side panel of claim 2, wherein said panel is formed of sheet metal construction material wherein said top, bottom and rear flange members have a plurality of bend lines for forming said pockets, and means for reinforcing said pocket members, said reinforcing means comprising a plurality of other bend lines extending along the substantial length of said front and rear flanges for bending said flanges in a direction away from said face and around and behind said pocket members.

4. The side panel of claim 2, wherein said pocket members form a substantially square U shape cross section.

5. The side panel of claim 1, wherein said front flange is spaced apart from said top and bottom flanges.

6. The side panel of claim 1 comprising means for mounting a door thereon further comprising two pairs of elongated holes disposed toward the said front edge of said panel and on the said face such that said pairs are in a space relationship and in a vertical, linear alignment extending from said top edge to said bottom edge and further where said holes are spaced in a relationship for substantial engagement with door bracket mounting means connected to a door.

7. A cabinet box comprising, in combination;

a pair of side panels each comprising a top edge including a top flange and an opposed bottom edge including a bottom flange; a front edge including a front flange and an opposed rear edge including a rear flange, said flanges defining a face, and wherein an upper pocket member formed from said top flange frames said face at the top edge, a lower pocket member formed from said bottom flange frames said face at the bottom edge, and a third rear vertical pocket member formed from said rear flange frames said face at the rear edge, wherein each said upper and lower pocket members is formed by having a first portion extending substantially perpendicular to said wall face, a second portion extending substantially perpendicular to the first portion and a third portion extending substantially perpendicular to said second portion;

a top panel comprising a front edge and opposed rear edge comprise a substantial C-shape cross section, and two opposed side edges where said side edges comprise a substantial C-shape cross section for alignable engagement with each of the upper pockets of each of said side panels resulting in a tightly fitted joint;

a bottom panel having substantial C-shaped side edges, and C-shaped front and rear edges, such that said side edges are formed for alignable engagement with each of the lower pockets of each of said side panels resulting in a tightly fitted joint, and;

a back panel comprising a top edge including a top flange and an opposed bottom edge including a bottom flange, and two opposed side edges including corresponding side flanges forming a substantial C-shape, said flanges defining a face wherein an upper pocket member formed from said top flange frames said face at the top edge, a lower pocket member formed from said bottom flange frames said face at the bottom edge, such that said rear edge of said top panel is matably engaged with the upper pocket of said back panel and the rear edge of said bottom panel is matably engaged with the lower pocket member of said back panel resulting in tightly fitted joints, and;

wherein said top, bottom, back and side panels interconnect to form said box.

8. The cabinet box of claim 7 comprising means for installing said box on a wall, said means comprising engaging a wall rail with a lip formed on the top edge of said back panel.

9. The cabinet box of claim 7 comprising means for installing said box on a ground surface and above said surface by support means.

10. The cabinet box of claim 7 whose construction material is sheet metal.

11. A cabinet box of claim 7 whose side panels are left and right side indiscriminate and comprise means for hanging a door for left or right handed attachment.

12. A cabinet box of claim 7 comprising leg leveling means.

13. A cabinet box of claim 7 comprising wall attachment means.

* * * * *